United States Patent [19]

Farmer et al.

[11] Patent Number: 4,608,128

[45] Date of Patent: Aug. 26, 1986

[54] METHOD FOR APPLYING ABRASIVE PARTICLES TO A SURFACE

[75] Inventors: Edward R. Farmer, Reading; Allyn N. Stillman, Cincinnati, both of Ohio

[73] Assignee: General Electric Company, Cincinnati, Ohio

[21] Appl. No.: 633,741

[22] Filed: Jul. 23, 1984

[51] Int. Cl.[4] ..... C25D 15/00

[52] U.S. Cl. ..... 204/16

[58] Field of Search ..... 204/16

[56] References Cited

U.S. PATENT DOCUMENTS

| | | | |
|---|---|---|---|
| 2,391,206 | 12/1945 | Van der Pyl | 204/16 |
| 3,046,204 | 7/1962 | Barron | 204/16 |
| 3,537,713 | 11/1970 | Matthews et al. | 277/55 |
| 3,537,960 | 11/1970 | Esola | 204/16 |
| 3,980,549 | 9/1976 | Grutza | 204/16 |
| 4,148,494 | 4/1979 | Zelahy et al. | 277/53 |
| 4,169,020 | 9/1979 | Stalker et al. | 204/16 |
| 4,227,703 | 10/1980 | Stalker et al. | 277/53 |
| 4,232,995 | 11/1980 | Stalker et al. | 415/172 A |

*Primary Examiner*—T. M. Tufariello

*Attorney, Agent, or Firm*—Lee H. Sachs; Derek P. Lawrence

[57] ABSTRACT

A method for applying preselected abrasive particles to an article surface includes providing an electrically non-conductive tape and particle member for use in an electrodeposition type system. The tape includes pores large enough to allow passage of electrodeposition current and electrolyte solution but smaller than the size of abrasive particles to be retained on the tape. The tape has a porous adhesive layer of relatively low tack level, the adhesive carrying the abrasive particles through a first or relatively weak bond. A metallic coating is electrodeposited through pores of the tape and adhesive onto the article surface and about the abrasive particles in contact with such surface. This bonds the abrasive particles to the article surface through a second bond between the metallic coating and the abrasive particle which is stronger than the first, relatively weak bond. Thereafter, the tape and particle member is separated at the first bond from the abrasive particles bonded to the article surface.

2 Claims, 3 Drawing Figures

METHOD FOR APPLYING ABRASIVE PARTICLES TO A SURFACE

The Government has rights in this invention pursuant to Contract No. F33657-81-C-0222 awarded by the United States Department of the Air Force.

This invention relates to articles carrying abrasive particles on a surface, such as gas seals between stationary and moveable members and, more particularly, to a method and a member for applying abrasive particles to a surface.

CROSS-REFERENCE TO RELATED APPLICATION

This application related to co-pending and concurrently filed application Ser. No. 633,742 entitled "Improved Electroplating Tape".

BACKGROUND OF THE INVENTION

In the gas turbine engine art, it is well known that the efficiency of certain components such as a compressor and a turbine is at least partially dependent on the extent to which compressed fluids such as air or combustion products leak through a space between blading members and cooperating shrouds. The clearance between such relatively moving parts can be designed within specific limits at a given temperature. However, during operation of a gas turbine engine from start up through various operating conditions to shut down, variation in temperatures cause non-uniform thermal expansion or contraction in a complex manner based on such factors as different materials of construction, different configurations, and different masses of materials. A number of reported arrangements have the object of reducing such an undesirable leakage.

One arrangement is described in U.S. Pat. No. 4,169,020—Stalker et al, issued Sept. 25, 1979, the disclosure of which is incorporated herein by reference. In such an arrangement, abrasive particles are provided on a projection such as a blade tip to cooperate with a relatively moving, opposed surface. The abrasive particles, when contacting such opposing surface, are intended to remove material from the surface in order to minimize clearance and reduce leakage between such relatively moving members.

A known method for applying such abrasive particles to a surface or a projection such as a blade tip is the codeposition of a bonding matrix and particles in an electrolyte bath onto a preselected surface. In one form of such an arrangement, the abrasive particles are suspended in the electrolyte bath and a metal matrix is codeposited with the particles at the selected surface to bond the particles to and entrap the particles at such surface. In another form of such method, abrasive particles are held in a bag about the surface and contact is provided under the electrolyte between the surface to be treated and the abrasive particles.

Abrasive particles which can be used for such purpose include oxides, nitrides, carbides, silicides, etc. Frequently used types include aluminum oxide, diamond and cubic boron nitride, one form of which is commercially available as Borazon material. Although some of such particles are relatively inexpensive, materials such as diamond and especially Borazon particles are very expensive. Use of known methods can result in a high loss or waste of such expensive materials.

SUMMARY OF THE INVENTION

It is an object of the present invention to provide an improved method for applying abrasive particles to a surface while economizing the use of abrasive particles.

It is another object of the present invention to provide, for use in such a method, a member which carries the abrasive particles and which allows relatively easy recovery of unused particles.

These and other objects and advantages will be more fully understood from the drawing and from the following detailed description and examples, all of which are intended to be representative of rather than in any way limiting on the scope of the present invention.

Briefly, the present invention in one form provides, in a method of applying preselected abrasive particles to a surface, the improved method of providing a member which is an electrically non-conductive tape carrying the abrasive particles. The tape has pores, voids or openings, herein called pores, large enough to allow passage through the tape of electrodeposition current and electrolyte solution but smaller than the size of the abrasive particles intended to be retained on the tape. Bonding the particles to the tape is an adhesive of relatively low tack level and having similar openings, disposed on a tape surface. As used herein, the designation "relatively low tack level" means an adhesion level which creates a bond between the adhesive and a particle weaker than a bond created between the particle and a coating securing the particle to an article surface. The abrasive particles are carried by the adhesive though a first bond. After cleaning the article surface, the abrasive particles carried by the tape are held at the article surface. A metallic coating is electrodeposited through pores of the tape and adhesive onto the article surface and about the abrasive particles at the article surface to bond the abrasive particles to the article surface through a second bond, between the metallic coating and the abrasive particles, stronger than the first bond. Thereafter, the tape and the abrasive particles are separated at the first or weaker bond thereby retaining the abrasive particles at the article surface through the second or stronger bond.

DESCRIPTION OF THE PREFERRED EMBODIMENTS

The present invention is particularly useful in connection with those components operating in the hot sections of a gas turbine engine because of the more extreme differences in rates of thermal expansion and contraction. However, the problems of leakage between relatively moving components can exist in other parts and components of the engine, for example in the compressor, at various seals, etc. Various kinds of turbine blade tips with which the present invention can be applied have been described in the literature, for example in U.S. Pat. No. 3,899,267, issued Aug. 12, 1975, in the above-identified Stalker et al patent, and elsewhere.

Figure 1:
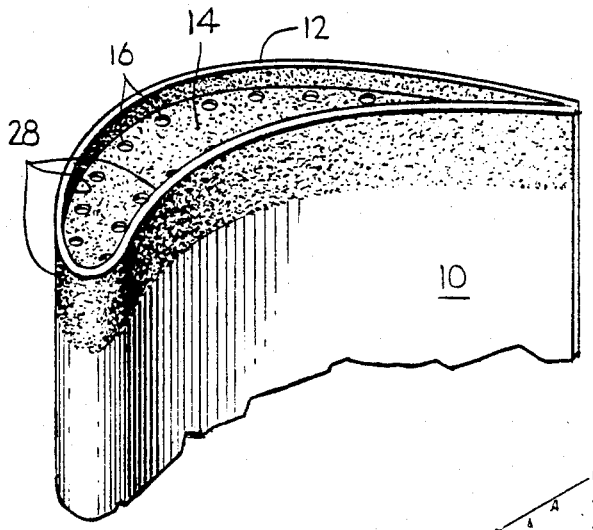
FIG. 1 is a fragmentary perspective view of the tip portion of an airfoil shaped turbomachinery blade.

The fragmentary perspective view of FIG. 1 is a presentation of the tip of one such blade. The blade airfoil 10 includes a tip surface 12 on which it is desirable to apply preselected abrasive particles for cooperation in relative movement with an opposing surface such as a shroud. Generally recessed from the end of airfoil 10 which terminates in tip surface 12 is an end plate 14 through which cooling fluid holes 16 can exist.

Figure 2:
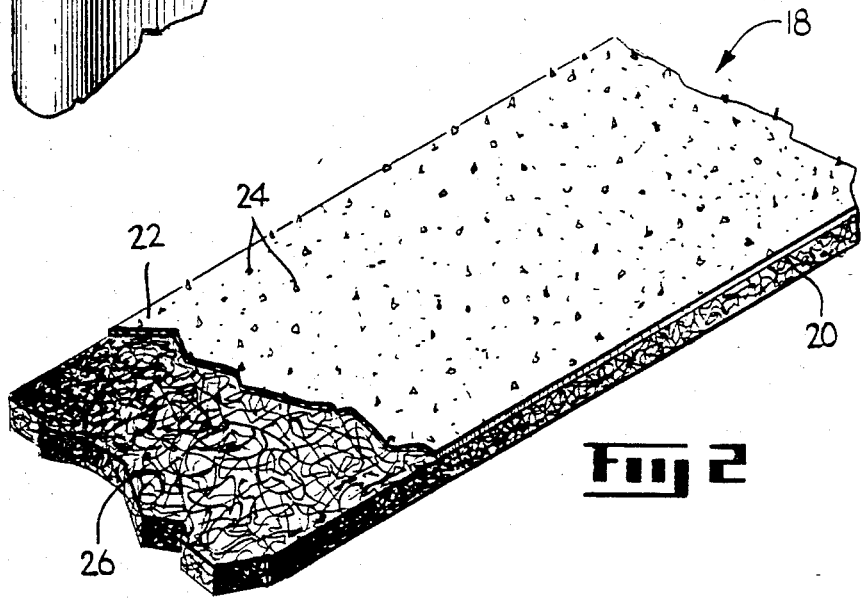
FIG. 2 is an enlarged, fragmentary, sectional, perspective view of a tape and particle member associated with the present invention.

According to one form of the present invention, there is provided a tape and particle member shown generally at 18 in FIG. 2. Such member comprises an electrically non-conductive tape 20, a thin, porous layer of an adhesive 22 of relatively low tack level on a surface of tape 20 and a plurality of abrasive particles 24 carried by the adhesive. Such a member can be prepared by sprinkling the particles on the adhesive surface and shaking off excess particles which do not adhere.

Electrically non-conductive tape 20 includes pores 26 large enough to allow passage therethrough of electrodeposition current and electrolyte solution but smaller than the size of abrasive particles 24 carried on the tape by adhesive 22. The porosity in tape 20 can result from tape 20 being made of a non-woven fabric or matte of electrically non-conductive fibrous material to enable the passage of electrodeposition current and electrolyte therethrough. Other forms can be more formal weaves of fibers, mechanically induced porosity, etc. A preferred form of such a porous tape is one commerically available from 3M Company as Scotch brand No. YR-394 vent tape. Such a tape is a flexible, non-woven fabric of a blend of textile fibers which includes thereon a thin, porous layer of synthetic elastomer adhesive of a low tack level of 1–2 oz. adhesion to steel per inch of width as tested by American Society of Testing Materials (ASTM) test D-3330. Flexibility in the tape is preferred for those applications in which it is desirable to have the tape follow the contour of a curved or more complex shaped surface. However, it should be understood that for applications to more planar or less complex surfaces, a more rigid, porous, electrically non-conductive product can be used as the "tape".

As was mentioned, adhesive 22 is porous to allow the passage of electrodeposition current and electrolyte solution. Also, it has a tack level sufficiently low to allow removal of the tape and adhesive from particles 24 after the particles have been bonded to an article surface, such as surface 12 in FIG. 1, through an electrodeposited coating. The commerically available Scotch brand tape No. YR394 includes such a porous adhesive layer on a surface.

As has been described above, the electrically non-conductive tape and particle member associated with the present invention comprises an electrically non-conductive tape having pores large enough to allow passage therethrough of electrodeposition current and electrolyte solution but smaller than the size of the abrasive particles on the tape. The tape has a porous adhesive layer of relatively low tack level on a tape surface. The member includes abrasive particles carried by the adhesive through a bond, herein called a first bond, which is intended to be weaker than a subsequently generated bond between a metallic coating and the abrasive particle. Such a subsequent bond is referred to herein as a second bond.

According to practice of the method of the present invention, for example with the blade tip described above in FIG. 1, after providing the electrically non-conductive tape and particle member, the article surface is cleaned to enable adherence of a subsequently electrodeposited metallic coating. Such cleaning can include mechanical abrasion such as through a vapor or air blast type process employing dry or liquid carried abrasive particles impacting the surface. Other cleaning methods which can be used include ultrasonic water rinsing, electrolytic cleaning for example in acid baths to anodically or cathodically clean the article surface, etc. Selection of such state of the art cleaning method, involving one or more combinations of steps, can be made according to the condition and type of article surface to which the abrasive particles are to be applied.

After cleaning the surface, it may be desirable to mask a portion of the article to avoid application to such portion of the electrodeposited metallic coating, the abrasive particles, etc. In this example, such a masking was applied as in FIG. 1 at 28 to those areas of the tip of airfoil 10 surrounding article surface 12 to which the abrasive particles are to be applied. Holes 16 were covered to avoid fluid penetration within airfoil 10. Masking can include the use of various kinds of lacquer, tape, etc., as is well known in the electroplating art.

After such preparation of the article, the abrasive particles 24 carried by adhesive 22 on tape and particle member 18 are held at the article surface such as 12 of the airfoil in FIG. 1 in an electrodeposition system. This enables electrodeposition of a metallic coating through pores in the tape and adhesive onto the article surface and about the abrasive particles at the article surface to bond the abrasive particles to the article surface through a second bond. Such bond is generated between the metallic coating and the abrasive particles, and is stronger than the first bond existing between the particles and adhesive.

Figure 3:
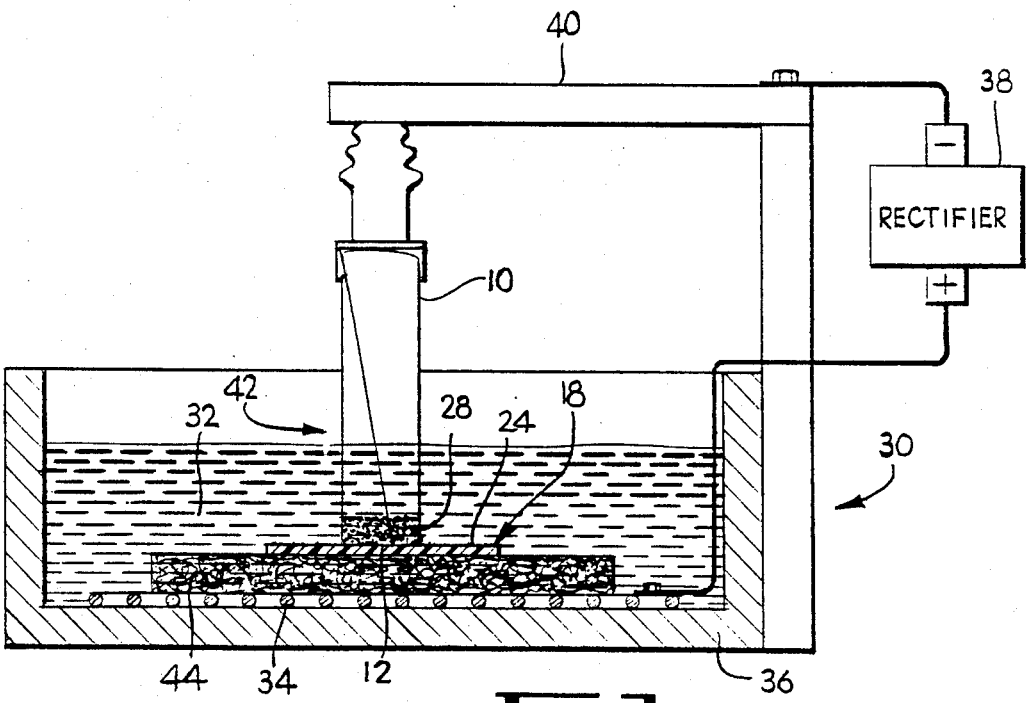
FIG. 3 is a diagrammatic, partially sectional view of one form of the method of the present invention in operation.

One preferred form of practice of the method of the present invention is shown in the diagrammatic view of FIG. 3. In that method form, an electrodeposition system 30 was provided with an electrolyte 32 and anodes 34 within electrolyte tank or container 36. The system included a direct current power source, such as rectifier 38, the positive side of which was connected with anodes 34. The negative side of the power source was connected through a movable support or clamp-down member 40 to an electrically conductive article such as turbomachinery blade member shown generally at 42 and including an airfoil 10, for example of the type shown in more detail in connection with FIG. 1. Airfoil 10 included an article surface 12.

The tape and particle member 18 shown in more detail in FIG. 2 was immersed and held in the electrolyte solution 32, with the abrasive particles 24 facing in a direction which enabled contact between the abrasive particles and article surface 12 to which the abrasive particles were to be applied. In a more specific form of the present invention, member 18 was disposed on a porous support pad 44, for example of a type commercially available as white Scotch-Brite material and through which electroplating current and electrolyte solution can pass.

Surface 12 of airfoil 10 was moved into contact with particles carried by the member while immersed in the electrolyte solution. When article 42 was connected with the negative side of rectifier 38 and appropriate electroplating current was applied, article 42 became the cathode which cooperated with anodes 34 under electrolyte 32 to electrodeposit the metallic coating from the electrolyte bath about the abrasive particles to provide the second bond described above. Because the second bond was stronger than the first bond between the particles and the adhesive, separation of airfoil 10 from contact with tape member 18, as by lifting, withdrew from the tape member those particles bonded to article surface 12 through the electrodeposited metallic coating. In this way, the abrasive particles were applied to the article surface.

The abrasive particles remaining on tape member 18 and not bonded to the article surface were then recovered from the tape for reuse. Such recovery was accomplished by burning away the tape and its adhesive in a furnace. As was mentioned before, practice of the present invention which enables use of a relatively thin layer of expensive abrasive particles is a significant improvement over known methods of placing the article surface 12 in contact with a significantly larger number of particles in a loose layer in the bottom of an electrolyte tank or within a porous bag, such as of cloth, loosely containing abrasive particles.

Although a single electrodeposited metallic coating has been described in connection with these examples and FIG. 3, it should be understood that subsequent additional deposition of metal can be applied about the particles thus bonded to surface 12. This was accomplished by additional electrodeposition of coatings, or can employ application of metal particles as through various spraying or vapor deposition techniques, etc. After deposition according to the present invention of the desired amount of material about abrasive particles 24 bonded to article surface 12, the masking materials 28 can be removed.

In another form of the method of the present invention, article surface 12, after cleaning, was further prepared to provide a surface more receptive to electrobonding of abrasive particles as described above. In this example, such preparation included electroplating a "strike" coating, but can include such techniques as vapor deposition coatings, etc. In this form of the method of the present invention, the above-described electrodeposition of the second bond metallic coating was applied to the prepared, "strike" coated surface rather than directly to the bare article surface.

A more specific example of the application of the method of the present invention used a gas turbine engine turbine blade of a nickel base alloy sometimes referred to as Rene' 80H nickel base superalloy. Tip surface 12 to which abrasive particles were to be attached was cleaned by first vapor blasting the surface until clean, flushing with water to remove residual abrasive media, and then drying the article with clean air. Thereafter, all airfoil holes, for example, those shown at 16 in FIG. 1 and any others on the airfoil were masked with platers' tape commonly used in the electroplating art. A masking lacquer then was brushed over the entire airfoil surface area at the vicinity of the airfoil tip. After drying, the lacquer was removed from airfoil tip surface 12. Surface 12 again was cleaned and then given a nickel "strike" coating in an aqueous nickel chloride electroplating bath, as is well known in the art.

The airfoil was then disposed in a nickel plating bath system as shown in FIG. 3. In the bottom of the tank of such system was a nickel anode over which was disposed a porous supporting pad identified commercially as Scotch-Brite material. The tape and particle member of the present invention was placed on the porous supporting pad. The member used was that described in connection with FIG. 2 and employed 3M vent tape No. YR394 along with Borazon cubic boron nitride abrasive particles. The tape and particle member was prepared by covering the porous tape with abrasive particles and shaking off excess particles not carried or bonded, through the first bond, by the adhesive. This provided a tape coated with a substantially single layer of lightly bonded abrasive particles.

Used for generating the metallic bonding in the electrodeposition system of this example was a nickel chloride type electrolyte which included boric acid and a wetting agent. The electrolyte covered the supporting pad, the tape and particle member, and the airfoil tip including exposed tip surface 12. Electrodeposition current at a current density of about 0.1 amp per square inch was applied to electrodeposit nickel as a coating onto the previously deposited nickel "strike" surface and about the abrasive particles in contact with such surface. This bonded the particles to the nickel "strike" surface and in turn to the airfoil tip surface represented by 12 in FIG. 1. After such electrodeposition to the desired thickness, the airfoil was removed from the electrodeposition system by withdrawing it away from the tape and particle member disposed on the porous supporting pad. Because the bond between the particles and the airfoil end portion was stronger than the bond between the particles and the electrically non-conductive tape, abrasive particles adhered to the article rather than remaining with the tape.

In this example, it was desirable to apply an additional coating about the particles for a heavier, more secure bond. Therefore, after deposition of the nickel electroplate coating from the nickel chloride solution, the tip of airfoil 10 carrying the abrasive particles was then immersed in an electrodeposition system including an electrolyte of the nickel sulfamate type including nickel metal, boric acid, and a wetting agent. Other types or combinations of types of electroplate or other coatings can be used. In this example, additional nickel electroplate was applied at a current density of about 0.4 amps per square inch after which the airfoil was removed from the plating bath and rinsed. Then the masking materials were removed.

The present invention has been described in connection with specific examples and embodiments. However, it will be readily understood by those skilled in the art, particularly the art of electrodeposition, the variations and modifications of which the present invention is capable without departing from its scope defined by the appended claims.

What is claimed is:

1. A method for applying preselected particles to a turbine engine blade tip comprising the steps of:

providing a tape and particle member;

(a) the tape of the member being electrically non-conductive and having pores large enough to allow passage therethrough of electrodeposition current and electrolyte solution but smaller than the size of abrasive particles on the tape;

(b) the tape having a porous adhesive layer of relatively low tack level on a tape surface; and (c) the abrasive particles being carried by the adhesive through a first bond;

cleaning the blade tip;

immersing blade tip and the tape and particle member in an electrolyte solution in spaced apart relationship in an electrodeposition system;

moving the blade tip into contact with the particles carried by the tape while immersed in the electrolyte solution;

electrodepositioning a metallic coating through pores of the tape and adhesive onto the blade tip and about the abrasive particles to provide a second bond, between the metallic coating and the abrasive particles, stronger than the first bond; and withdrawing to separate the blade tip from the tape and particle member at the first bond while immersed in the electrolyte solution.

2. The method of claim 1 including, after cleaning the blade tip, the steps of:

applying a first metallic coating to the blade tip;

holding the abrasive particles carried by the tape at the first metallic coating;

electrodepositing a second metallic coating through pores of the tape and adhesive onto the first metallic coating and about the abrasive particles at the first metallic coating to bond abrasive particles to the first metallic coating through a second bond stronger than the first bond; and separating the member at the first bond from the abrasive particles bonded to the first metallic coating.

* * * * *